United States Patent [19]

Dowd et al.

[11] Patent Number: 4,931,156

[45] Date of Patent: Jun. 5, 1990

[54] DISTRIBUTIVE ANODE COATING

[75] Inventors: James P. Dowd, Louisville; Charles C. Boyer, Prospect, both of Ky.; Gary W. Gardner, Elizabeth, Ind.

[73] Assignee: Duochem, Inc., Boucherville, Canada

[21] Appl. No.: 601,932

[22] Filed: Apr. 19, 1984

[51] Int. Cl.[5] ..... C23F 13/00

[52] U.S. Cl. ..... 204/147; 52/515; 52/727; 204/196; 204/294

[58] Field of Search ..... 204/294, 147, 148, 196, 204/197

[56] References Cited

U.S. PATENT DOCUMENTS

| | | | |
|---|---|---|---|
| 2,433,212 | 12/1947 | Gleave | 204/294 |
| 3,151,050 | 9/1964 | Wilburn . | |
| 3,475,304 | 10/1969 | Currey . | |
| 3,507,773 | 4/1970 | Grangaard . | |
| 3,509,088 | 4/1970 | Dalton . | |
| 4,231,854 | 11/1980 | Boehlke et al. | 204/294 |
| 4,255,241 | 3/1981 | Kroon . | |
| 4,502,929 | 3/1985 | Stewart et al. | 204/196 |
| 4,506,485 | 3/1985 | Apostolos | 204/147 |

FOREIGN PATENT DOCUMENTS

| | | | |
|---|---|---|---|
| 1111602 | 7/1961 | Fed. Rep. of Germany . | |
| 2045802A | 11/1980 | United Kingdom | 204/197 |

OTHER PUBLICATIONS

Electrified Potholes, Sciquest vol. 179, No. 1, p. 28.

Brown, Corrosion 83, Paper No. 179, International Corrosion Forum, Apr. 18–22, 1983.

*Primary Examiner*—T. Tung

*Attorney, Agent, or Firm*—Cushman, Darby & Cushman

[57] ABSTRACT

Cathodic protection to prevent corrosion of embedded steel, e.g. reinforcing rods in concrete, is obtained by applying a graphite-alkyl methacrylate composition to the exterior of the concrete.

15 Claims, 2 Drawing Sheets

DISTRIBUTIVE ANODE COATING

BACKGROUND OF THE INVENTION

The invention is directed to the improved corrosion resistance of steel reinforced concrete.

Concrete structures containing embedded reinforcing bars are widely used. When these structures are exposed to salts over long periods of time severe corrosion of the reinforcing bars occurs. The corrosion products expand and crack the concrete. This causes massive failure of the structure.

One method of protecting these structures is to coat the reinforcing bars. This method can only be used on new structures. Another method is to add a corrosion inhibitor to the concrete before it is poured. Again this can be used only on new structures. There are thousands of preexisting concrete structures in this country that are corroding.

One method of protecting the embedded steel in these structures is by cathodic protection, see Corrosion 83, Paper No. 179, The International Forum, Apr. 18–22, 1983. The negative pole of a direct current source is connected to the steel to be protected. The positive pole or anode is connected to the exterior of the concrete structure.

One of the problems associated with this process is getting an even distribution of current to the surface of the reinforcing metal to be protected. The prior art attempts to solve this problem by adding coke or other conductive materials to the concrete. This method is expensive and changes the mechanical properties of the concrete. Another method is to paint the concrete with a coating containing a conductive pigment. Paints of prior art containing conductive pigment are hard to apply and lose adhesion to the concrete when subjected to the combined stress of current flow and ambient moisture conditions.

SUMMARY OF THE INVENTION

Unexpectedly, it has been found that compositions comprising finely divided graphite dispersed in a solution of certain methacrylate resins when applied to the exterior of iron and steel reinforced concrete structures will dry to a conductive anode which remedies the prior art deficiencies. The coatings of the invention are resistant to freezing and do not flake off or lose their adhesion as is the case with prior art coatings.

The conductive paint or coating of the invention is applied to the exterior of the concrete and assists in even distribution of the electric current. The conducting coating is employed using platinum anodes attached to the outside of the structure. The invention has the advantage of requiring fewer of the expensive anodes and also requires less wiring than prior art procedures.

While prior art paints containing conductive pigments ar hard to apply and lose adhesion to the concrete when subjected to the combined stresses of current flow and ambient moisture conditions, the coating compositions of the invention provide good long term conductivity and film integrity when subjected to the combined stresses of current flow and ambient moisture conditions.

The structures include, but are not limited to reinforced concrete bridge decks, buildings, parking structures, piers, marine structures, roads, pilings, etc.

The choice of methacrylate is critical. Thus neither homopolymers of methyl methacrylate or butyl methacrylate are suitable but they can be used satisfactorily in the form of copolymers that consist of from 40 to 60% methyl methacrylate to 60 to 40% butyl methacrylate (although the range may be extended, e.g. from 30 to 70% methyl methacrylate to 70 to 30% butyl methacrylate). The preferred material is a 60% butyl methacrylate and 40% methyl methacrylate copolymer. Conductive coatings of graphite with this copolymer have maintained their integrity on steel reinforced concrete through 100 freeze-thaw cycles.

Less preferably there can be employed poly(ethyl methacrylate) or poly(isobutyl methacrylate).

The solvents employed are not critical to the embodiment of this invention because the solvent does not remain in the final coating. However, solvent selection is important to insure application and film formation properties.

It has been found that the following nonacrylic binders are unsatisfactory: epoxy resins, epoxy polyether resins, coal tar, vinyl chloride-vinyl acetate copolymer and chlorinated rubber. They had poor conductivity and did not perform well in the sodium hypochlorite tests set forth below.

The graphite employed as the conductive substance can be amorphous or crystalline, but amorphous is preferred. The graphite should be finely divided e.g., 100 mesh or smaller and preferably passes through a 325 mesh (Tyler) screen (44 microns). The preferred amorphous graphite is Mexican graphite. Crystalline Ceylon graphite and China graphite did not do as well on the sodium hypochlorite test as the Mexican graphite. Other forms of carbon such as carbon black furnace black, lampblack, and acetylene black are unsuitable.

The ratio of graphite to alkyl methacrylate polymer can vary widely, e.g. from 1.94 to 5.82:1. The preferred ranges are given below and depend on the particular resin employed.

The coating of the present invention is preferably applied at a thickness of 15 mils. The range of thickness can vary, however, for example, from 5 to 20 mils or even up to 50 mils.

As is conventional in the art the conductive coating of the invention can be top coated with a suitable topcoat, e.g. an acrylic latex or conventional enamel. The topcoat, however, is not essential to the invention.

As indicated above amorphous graphite is preferred. This is particularly true in regard to use where the reinforced concrete is subjected to severe salt conditions e.g., pilings, piers, or support structures standing in salt water. The crystalline graphite is not as good as the amorphous graphite in the sodium hypochlorite test described below. For satisfactory results under severe salt conditions, the coating should pass the test for 24 hours. However, for some uses, e.g. where there is relatively low salt content in the concrete, the conductive coating can be employed if it passes the sodium hypochlorite test for a lesser period of time, e.g. 2, 4, or 8 hours. However, the longer it passes the sodium hypochlorite test the better since the field of use is greater.

It is also important that the coating possess good conductivity. In this respect ethyl methacrylate polymer is inferior to methyl methacrylate-butyl methacrylate copolymers.

The distributive anode coating composition of the invention can be applied to the concrete by any of the conventional techniques, e.g., brushing, spraying, or rolling or by the drawn-down method, the latter method only being suitable for laboratory use. The draw down method was employed in the conductivity measurement and hypochlorite tests described below to insure uniform film application and thickness. For commercial applications the brush and spray methods will usually be employed.

Laboratory tests indicate that on clean concrete no special preparation is necessary. For best results, the concrete surface should be clean, dry, properly cured and free from curing compounds, oil, grease, dirt, chemical contaminants, waxes, or previously applied coatings which could insulate the distributive anode coating from the concrete. All cracks, openings, or construction defects should be repaired prior to application of the distributive anode coating. All metal to be protected within the concrete must be covered by concrete to prevent short circuiting of the cathodic protection system.

The formulations tested were screened for:

1. Electrical Conductivity
2. Sodium Hypochlorite Resistance

The electrical conductivity was determined using a test method of applicants' own design and measurements are reported in Micromhos. Basically, this test consists of applying the Distributive Anode coating to a non-conductive substrate and measuring the conductivity. Although there cannot be defined absolute conductivity measurements that produce the optimum distributive anode coating it is believed that the best distributive anode coating is one that gives the highest conductivity and still maintains good integrity. The integrity of the distributive anode coating was determined by the Sodium Hypochlorite Resistance Test. Chlorine and Sodium Hypochlorite are known to be generated when an electrical current is passed through salt water. Hence, a successful anode coating must be resistant to sodium hypochlorite. The test consists of applying a cotton ball soaked with a 5% sodium hypochlorite solution to a film of the distributive anode coating on clean steel. After time intervals up to 24 hours the distributive anode coating was evaluated for the presence of rust on the surface of the film. If rust was observed, then the coating was rated as failed at that point in time. If there is no rust the coating passes at that particular point in time.

The method of the invention comprises cathodically protecting steel reinforcing bars which are embedded in concrete comprising (a) connecting the negative pole of a direct current source to the embedded reinforcing bars, (b) connecting the positive pole of the direct current source to the surface of the concrete using a conductive anode coating consisting essentially of a mixture of graphite and a polymer which is methyl methacrylatebutyl methacrylate copolymer, ethyl methacrylate homopolymer or isobutyl methacrylate homopolymer.

DETAILED DESCRIPTION

Figure 1:
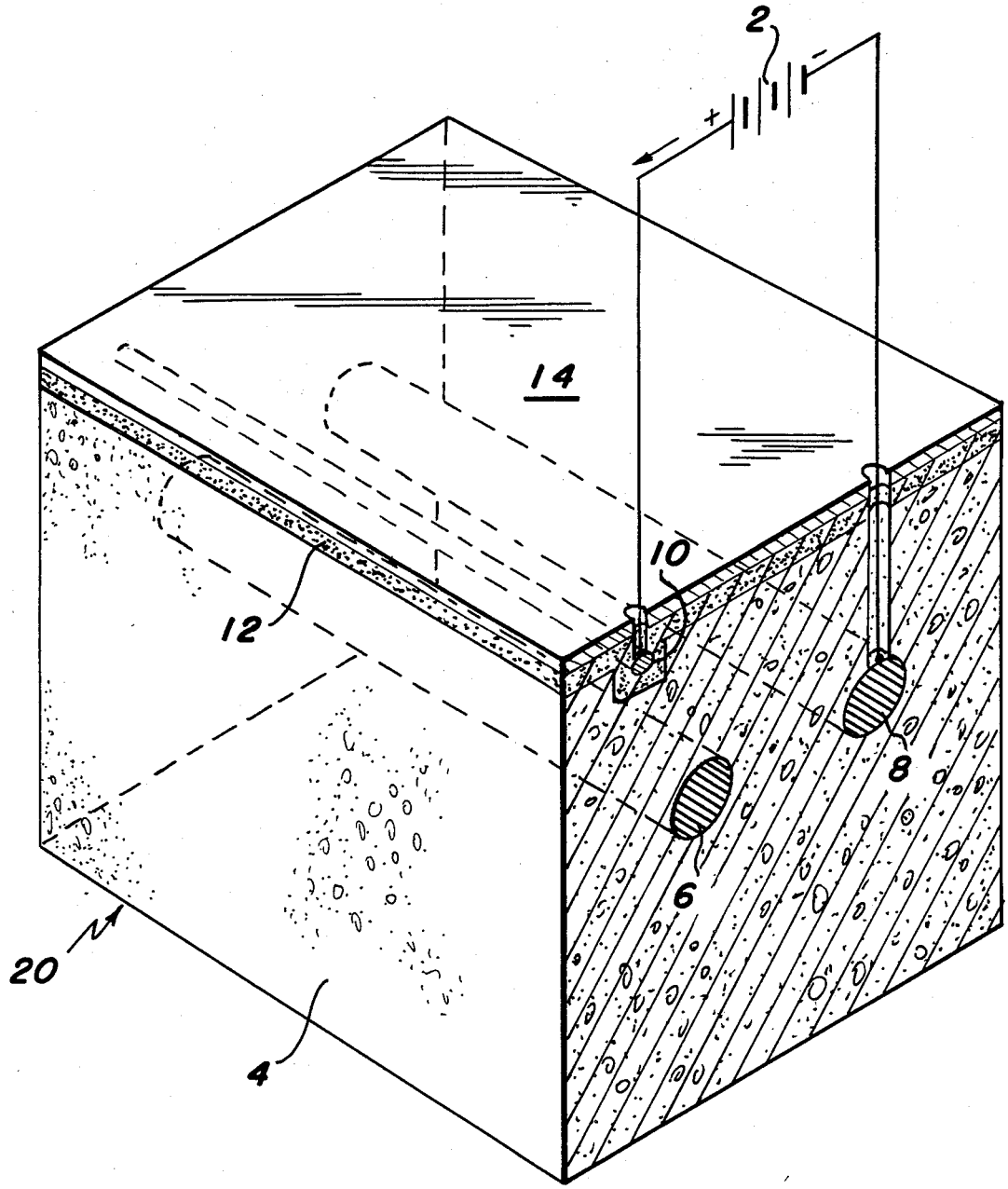
FIG. 1 is an illustration of a portion of the Distributive Anode Coating Cathodic protective system for steel of the reinforced concrete of the invention shown in cross section.

As shown in FIG. 1 there is provided a DC power input 2 which impresses a voltage opposing galvanic corrosion in the direction of the arrow to the reinforced concrete member designated generically as 20 (e.g. a bridge pier). The reinforced concrete member comprises concrete 4 having steel rebars 6 and 8 running through it. The reinforced concrete has a distributive anode coating 12 of the invention, e.g. graphite-methyl methacrylate-butyl methacrylate copolymer (e.g. 60:40). The anode wire, e.g. of platinum, is designated 10. There is also shown an optional topcoat 14 made of any conventional material, e.g. of an enamel or an acrylic latex.

Figure 2:
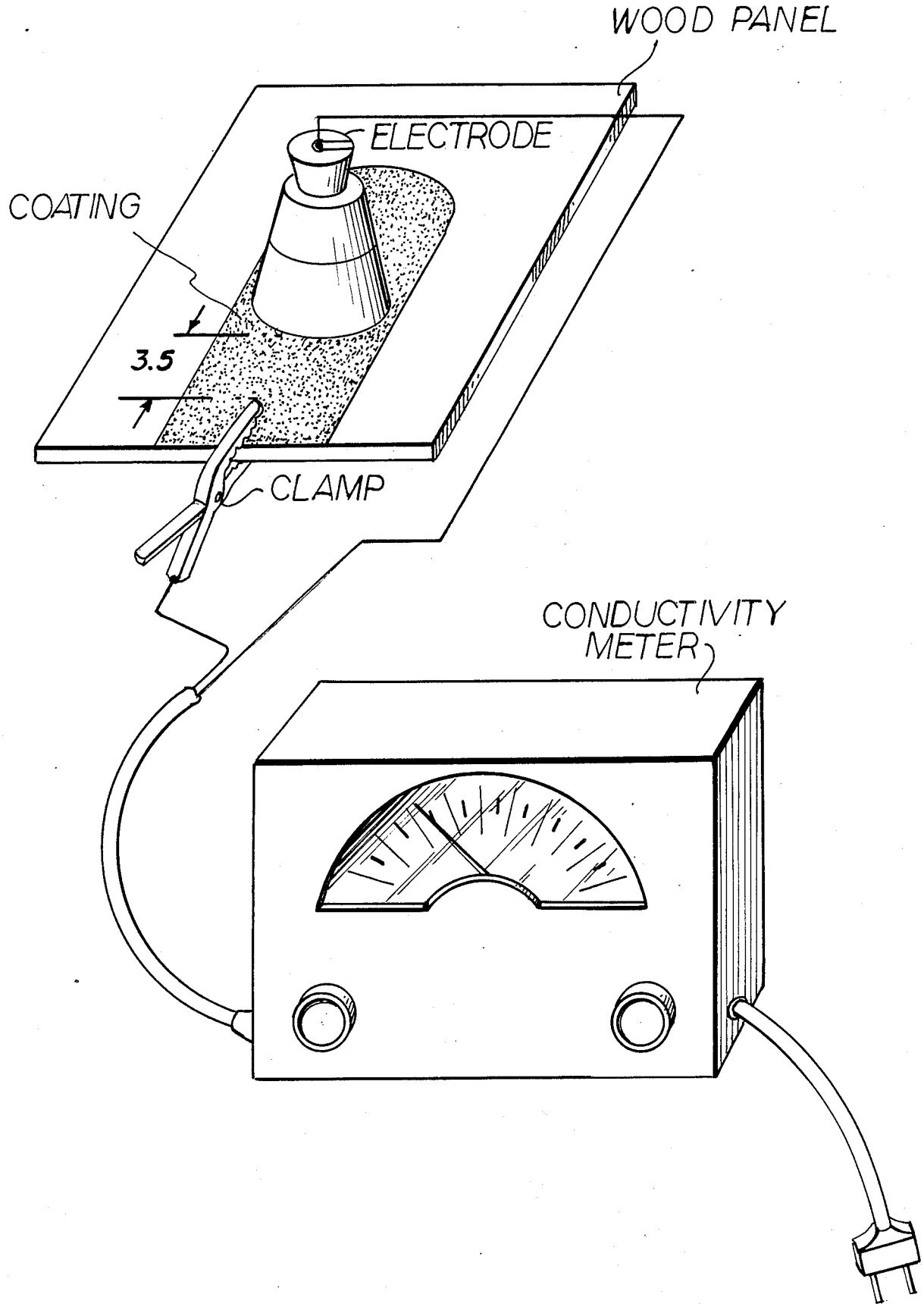
FIG. 2 is an illustration view of the apparatus for testing conductivity.

FIG. 2 shows the apparatus for the conductivity test including a conductivity meter and the test panel. The electrodes are spaced 3.5 cm apart on the coating. The test procedure has been described above.

Unless otherwise indicated all parts and percentages are by weight.

The process can comprise, consist essentially of, or consist of the stated steps with the recited materials. The composition can comprise, consist essentially of, or consist of the stated materials.

In the following examples the PB ratio is defined as follows:

$$PB = \frac{A}{B(C/100)}$$

$A$ = Wt. Graphite $B$ = Wt. Resin $C$ = Percent Solids of the Resin solution by weight

Example 1

| | |
|---|---|
| 50% solution of Methyl methacrylate-butyl methacrylate copolymer (40:60) in xylene | 5680.5 parts |
| Xylene | 3137.3 |
| Propylene glycol monomethyl ether | 3274.2 |
| Diacetone alcohol | 156.9 |
| Graphite (amorphous Mexican, 325 mesh) | 11021.5 |
| The PB ratio is 3.88:1. | |

The resin solution and solvents were charged into a mild steel tank equipped with an agitator and mixed until uniform. The powdered graphite was then added slowly.

The resulting product was smooth, lump free, and had a buttery consistency. When applied to concrete it dried to a smooth, flat, jet-black coating. It could be applied at dry film thicknesses of 15 mils or more without sagging.

The conductivity in the test illustrated in FIG. 2 was 770 micromhos. The coating passed 24 hours sodium hypochlorite resistance.

This material was applied to bridge piers in Illinois and Florida. After one months' use in the cathodic protection system described above, the material is working satisfactorly with no loss of adhesion nor other visible signs of deterioration.

The coating procedure in the subsequent examples was basically that used in Example 1.

Example 2

The procedure of Example 1 was repeated but utilizing different forms of carbon

| Various Forms of Carbon | | | |
|---|---|---|---|
| Type | Conductivity Micromhos | Sodium Hypochlorite Test | PB Ratio |
| Graphite 325 Mesh amorphous (Control) Mexican graphite | 770 | Pass 24 hours | 3.88 |
| #9 Coke 200 Mesh | 750 | Failed 24 hours | 3.88 |
| Carbon Black | 300 | Pass 24 hours | 1.63* |

*This was the maximum amount of Carbon Black that could be added to the formulation. At this level the film cracks and has poor adhesion.

Example 3

The procedure of Example 1 was repeated using the indicated polymers

| Various Acrylic Binders | | | |
|---|---|---|---|
| Polymer Type | Conductivity Micromhos | Sodium Hypochlorite Test | PB Ratio |
| Methyl/Butyl Methacrylate (control) (40:60) | 770 | Pass 24 hours | 3.88 |
| Methyl/butyl methacrylate (50:50) | 675 | Pass 24 hours | 3.88 |
| Methyl/butyl methacrylate (60:40) | 675 | Failed 24 hours<br>Passed 8 hours | 3.88 |
| Methyl Methacrylate | 625 | Failed 24 hours<br>Failed 1 hour | 3.88 |
| Ethyl Methacrylate | 50 | Pass 8 hours | 3.88 |
| Butyl Methacrylate | 300 | Failed 24 hours<br>Failed 1 hour | 3.88 |
| Isobutyl Methacrylate | 325 | Failed 24 hours<br>Pass 2 hours | 3.88 |
| Methyl Acrylate | 400 | Failed 24 hours<br>Failed 1 hour | 3.88 |

325 Mesh Amorphous Mexican Graphite was used in all of the above test.

Example 4

A series of tests were carried out at various PB ratios using ethacrylate polymer.

| PB Ratio | Conductivity Micromhos | Sodium Hypochlorite |
|---|---|---|
| 3.88 | 50 | All pass 8 hrs<br>1 of 6 pass 24 hrs |
| 4.27 | 150 | All pass 8 hrs<br>1 of 6 pass 24 hrs |
| 4.85 | 200 | All pass 8 hrs<br>All fail 24 hrs |
| 5.82 | 450 | All pass 4 hrs<br>All fail 5 hrs |

325 Mesh Amorphous Mexican Graphite was used in all of the tests.

With ethyl methacrylate the satisfactory PB ratio range is 3.8 to 5.82. The preferred range 4.3 to 5.8 and the optimum range 4.8 to 5.8.

Example 5

The series of tests were carried out with various PB ratios using methyl methacrylate-butyl methacrylate copolymer (40:60)

| PB Ratio | Conductivity Micromhos | Sodium Hypochlorite |
|---|---|---|
| 1.94 | 150 | Pass 24 hours |
| 3.88 | 770 | Pass 24 hours |
| 4.27 | 600 | All pass 8 hrs<br>5 of 6 pass 24 hrs |
| 4.85 | 850 | All pass 8 hrs<br>3 of 6 pass 24 hrs |
| 5.82 | 1200 | All pass 4 hrs<br>All fail 5 hrs |

325 Mesh Amorphous Mexican Graphite was used in all of the tests.

With the methyl methacrylate-butyl methacrylate copolymer (40:60) the satisfactory PB ratio range is 1.94 to 5.82, preferred range 3.00 to 4.85 and the optimum range 3.5 to 4.3.

Example 6

Various non-acrylic binders were also tried with the results indicated below:

| Coating Type | Conductivity Micromhos | Sodium Hypochlorite Test | PB Ratio |
|---|---|---|---|
| Epoxy | 125 | Failed 24 hrs | 3.88 |
| Epoxy Polyether | 125 | Failed 24 hrs | 3.88 |
| Coal Tar | 125 | Failed 24 hrs | 3.88 |
| Vinyl Chloride-Vinyl Acetate Copolymer | 100 | Failed 24 hrs | 3.88 |
| Chlorinated Rubber | 100 | Failed 24 hours | 3.88 |

325 Mesh amorphous Mexican Graphite was used in all of the above tests.

What is claimed is:

1. In a method for cathodically protecting steel reinforcing bars which are embedded in concrete comprising (a) connecting the negative pole of a direct current source to the embedded reinforcing bars, (b) connecting the positive pole of the direct current source to the exterior of the concrete containing the embedded reinforcing bars, the improvement comprising having a conductive anode coating on the surface of the concrete consisting essentially of a mixture of graphite and a polymer which is methyl methacrylate-butyl methacrylate copolymer, ethyl methacrylate homopolymer or isobutyl methacrylate homopolymer.

2. The method of claim 1 wherein the graphite is amorphous graphite.

3. The method of claim 2 wherein the copolymer containing 30 to 70% methyl methacrylate and the ratio of graphite to polymer is from 1.94 to 5.82:1.

4. The method of claim 3 wherein the copolymer contains 40 to 60% methyl methacrylate.

5. The method of claim 4 wherein the copolymer contains 40% methyl methacrylate.

6. A concrete structure containing steel reinforcing bars having an exterior protective coating layer consisting essentially of a mixture of graphite and a polymer which is methyl methacrylatebutyl methacrylate copolymer, ethyl methacrylate homopolymer or isobutyl methacrylate homopolymer.

7. A concrete structure according to claim 6 wherein the graphite is amorphous graphite.

8. A concrete structure according to claim 7 wherein the polymer is methyl methacrylate-butyl methacrylate copolymer containing 30 to 70% methyl methacrylate and the ratio of graphite to polymer is from 1.94 to 5.82:1.

9. A concrete structure according to claim 8 wherein the copolymer contains 40 to 60% methyl methacrylate.

10. A concrete structure according to claim 9 wherein the copolymer contains 40% methyl methacrylate.

11. A concrete structure according to claim 10 wherein the ratio of graphite to polymer is 3.00 to 4.85:1.

12. A concrete structure according to claim 11 wherein the ratio of graphite to polymer is 3.5 to 4.3:1.

13. A concrete structure according to claim 12 wherein the coating has a thickness of about 15 mils.

14. A concrete structure according to claim 13 wherein the graphite has a maximum particle size of about 44 microns.

15. A concrete structure according to claim 11 wherein the graphite has a maximum particle size of about 44 microns.

* * * * *